US005356356A

United States Patent [19]

Hildebrandt et al.

[11] Patent Number: 5,356,356

[45] Date of Patent: Oct. 18, 1994

[54] RECUMBENT TOTAL BODY EXERCISER

[75] Inventors: Mark D. Hildebrandt; Steven W. Sarns, both of Ann Arbor; Todd A. Sutton, Grand Rapids, all of Mich.

[73] Assignee: Life Plus Incorporated, Ann Arbor, Mich.

[21] Appl. No.: 71,188

[22] Filed: Jun. 2, 1993

[51] Int. Cl.[5] ..... A63B 21/00

[52] U.S. Cl. ..... 482/62; 482/57

[58] Field of Search ..... 482/51, 52, 53, 57, 482/60, 62, 63, 133; 128/25 R; 280/233

[56] References Cited

U.S. PATENT DOCUMENTS 4,529,194 7/1985 Haabeim .
4,645,200 2/1987 Hix .
4,684,126 8/1987 Dalebout et al. .
4,842,268 6/1989 Jenkins .
4,869,494 9/1989 Lambert, Sr. .
4,936,573 6/1990 Miller .
4,949,954 8/1990 Hix .
5,242,179 9/1993 Beddome et al. ..... 482/62
5,254,067 10/1993 Habing et al. ..... 482/53

*Primary Examiner*—Stephen R. Crow
*Attorney, Agent, or Firm*—Harness, Dickey & Pierce

[57] ABSTRACT

A recumbent exercise device which provides lower body, upper body and cardiovascular conditioning. The device includes a frame having a seat supported toward the rear thereof. A pair of leg assemblies and a pair of arm assemblies are pivotally supported by the frame for movement about a transverse pivot axis. The arm and leg assemblies are positioned generally toward the forward end of the frame and each includes an upward and forward extending lever with the leg assemblies terminating in pedals and the arm assemblies terminating in handles. The arm and leg assemblies are connected to each other for contralateral movement. A resistance mechanism is coupled to the arm and leg assemblies to provide resistance to their movement the pivot axis. An open area is defined above the frame between the seat and the arm and leg assemblies to permit step-through access to the seat regardless of the arm and leg assembly positions.

19 Claims, 5 Drawing Sheets

RECUMBENT TOTAL BODY EXERCISER

BACKGROUND AND SUMMARY OF THE INVENTION

This invention generally relates to equipment for physical therapy and/or general exercise. More particularly, this invention relates to a recumbent exercise machine which provides for the exercising and strengthening of major muscle groups in addition to cardiovascular conditioning. In so doing, the present invention includes lower body exercising coordinated with upper body exercising.

Patients undergoing physical therapy, whether at home, in the hospital or in another clinical setting, have special needs when it comes to physical therapy equipment. Often, the patients have limited mobility, age related illnesses, decreased ranges of appendage movement, disabilities, low endurance and need for therapy with respect to more than one particular movement or muscle group. All of these factors must be taken into consideration when designing or providing equipment for their use.

Those people who exercise for its many health benefits, and not specifically for rehabilitation purposes, typically desire equipment which is challenging, safe, fun, effective, convenient and which provides a benefit to a multiple number of muscle groups so that a total body workout is achieved in a relatively short period of time. When the equipment is for home use, other important considerations include durability and cost.

Numerous types and varieties of physical therapy and exercise equipment are available for both clinical and home use. Of the many types, two of the most popular include the stepping machines (hereinafter "steppers") and the stationary bicycles. Each of these machines, however, has certain limitations concerning their ease of use, range of movement, safety, the muscle groups worked and their cost.

Generally, steppers include a pair of pedals which move up and down, thereby simulating the climbing of steps, in response to the weight and physical effort of the patient or exerciser (hereinafter "user"). The pedals are connected to a mechanism which applies a resistance or load. This resistance is often adjustable so that the stepper can accommodate users of various levels of physical conditioning and ability.

One limitation of steppers is that the user is typically required to stand during the exercise. Since the user is in an upright position, a significant amount of balance and coordination on the part of the user is required. Because of the decreased mobility and coordination, this may prevent a patient undergoing physical therapy from using the stepper. A related limitation of the stepper is that it requires continuous close supervision when being used by a person undergoing physical rehabilitation. Close supervision by a physical therapist or assistant is required to ensure that the patient does not collapse or otherwise lose balance and fall from the stepper resulting in an injury. A further limitation of the stepper is its lack of exercise or conditioning of the upper body of the user. Finally, steppers may elevate the heart rate and the blood pressure too quickly for unconditioned and elderly patents, potentially causing harm.

One limitation of stationary bicycles is that the seat is typically a narrow saddle seat positioned above a pair of rotatable pedals having a fixed range of motion. The rotation of the pedals is resisted by a brake or other resistance mechanism. The user is required to lean forward to hold onto a set of handles, which may be stationary or movable. In order to use a stationary bicycle, the user must be capable of climbing up onto the seat and must possess sufficient strength, balance and coordination to maintain themselves on the narrow seat while pedaling over a fixed range of motion and manipulating the handles if they are of the moveable variety. Often the elderly, overweight or physical therapy patient cannot use a stationary bike because of the above requirements and further because they require constant supervision by the physical therapist to prevent possible injury to the patient upon collapse or loss of balance.

As can be seen from the above discussion, there is the need for an apparatus which allows the user to easily get on and off the apparatus with or without assistance. Furthermore, the apparatus should provide a high degree of stability and safety to the user so that the user can manipulate the machine without constant attention or supervision. Additionally, the apparatus should be adjustable to accommodate users of the significantly different sizes and physical conditions while still being comfortable.

Accordingly, it is an object of the present invention to provide an apparatus which overcomes the limitations of the known prior art. In so doing, a further object of this invention is to provide a recumbent apparatus which can be easily mounted and dismounted by a user having a limited amount of mobility, with or without the assistance of another person.

The present invention also has as one of its objects providing an apparatus which uses a stepping or oscillating arcuate motion to provide a lower body workout or therapy. A further object of the invention is to provide an apparatus which uses an oscillating arcuate motion to provide an upper body workout or therapy.

Another object of this invention is to provide an apparatus which is familiar to use and which simulates the coordinated arm and leg movements used during walking or running. To this end, the invention also has as one of its objects providing upper body exercise which is diagonally coordinated with lower body exercise.

Still another object of the present invention is to provide a physical therapy and exercise apparatus which is easy to use, has adjustable resistance levels, is durable and which is relatively inexpensive to produce.

In achieving the above objects, the present invention provides for a recumbent total body exercise apparatus. The apparatus includes pedals which undergo an oscillating or stepping motion. The pedals are contralaterally synchronized with handles that also undergo a oscillating motion providing the user with a total body conditioning workout.

Unlike common stationary bicycles where the user is positioned on a seat above the pedals, the present invention utilizes a recumbent seat which is horizontally displaced from the pedals. The seat itself is a full bucket style seat, including a seat cushion an a seat back, positioned at a normal chair height. This provides a safe, stable and familiar seating position for the user. When used during physical therapy, the stability of the seat assures the physical therapist or assistant that the patient can use the apparatus with only moderate supervision thereby freeing the physical therapist to attend to other patients or other duties.

The exerciser of the present invention is also provided with an open center region, immediately before the seat, having a low profile step-through design offering easy ingress and egress to the user. Thus, a patient with low mobility is not required to climb up onto the apparatus or raise a leg over a high center portion of a frame. Rather, the user can easily step over a low center height portion of the apparatus' frame and sit down as would be normally done in a chair.

Once seated, the position of the chair relative to the pedals can be adjusted, as well as the length of the handles relative to the chair, for the size of the particular user. The relationship and geometry of the chair, the pedals, the handles, and the position of the pivot for the handles and pedals is such that the movement of the user's arms and legs will be maintained in a correct biomechanical relationship or form. The maintenance of proper form ensures efficient conditioning in addition to a comfortable exercising or therapy position.

During use of the apparatus, the pedals and handles undergo their coordinated movement against a resistance force provided by one of the variety of known resistance mechanisms. The level of resistance provided by the resistance mechanism is adjustable to accommodate users of all fitness levels. Also, the resistance mechanism may be electronically controlled to produce a resistance pattern representing a therapy or workout cycle of varied physical difficulty.

Additional benefits and advantages of the present invention will become apparent to those skilled in the art to which this invention relates from the subsequent description of the preferred embodiment and the appended claims, taken in conjunction with the accompanying drawing.

DETAILED DESCRIPTION OF THE PREFERRED EMBODIMENT

Figure 1:
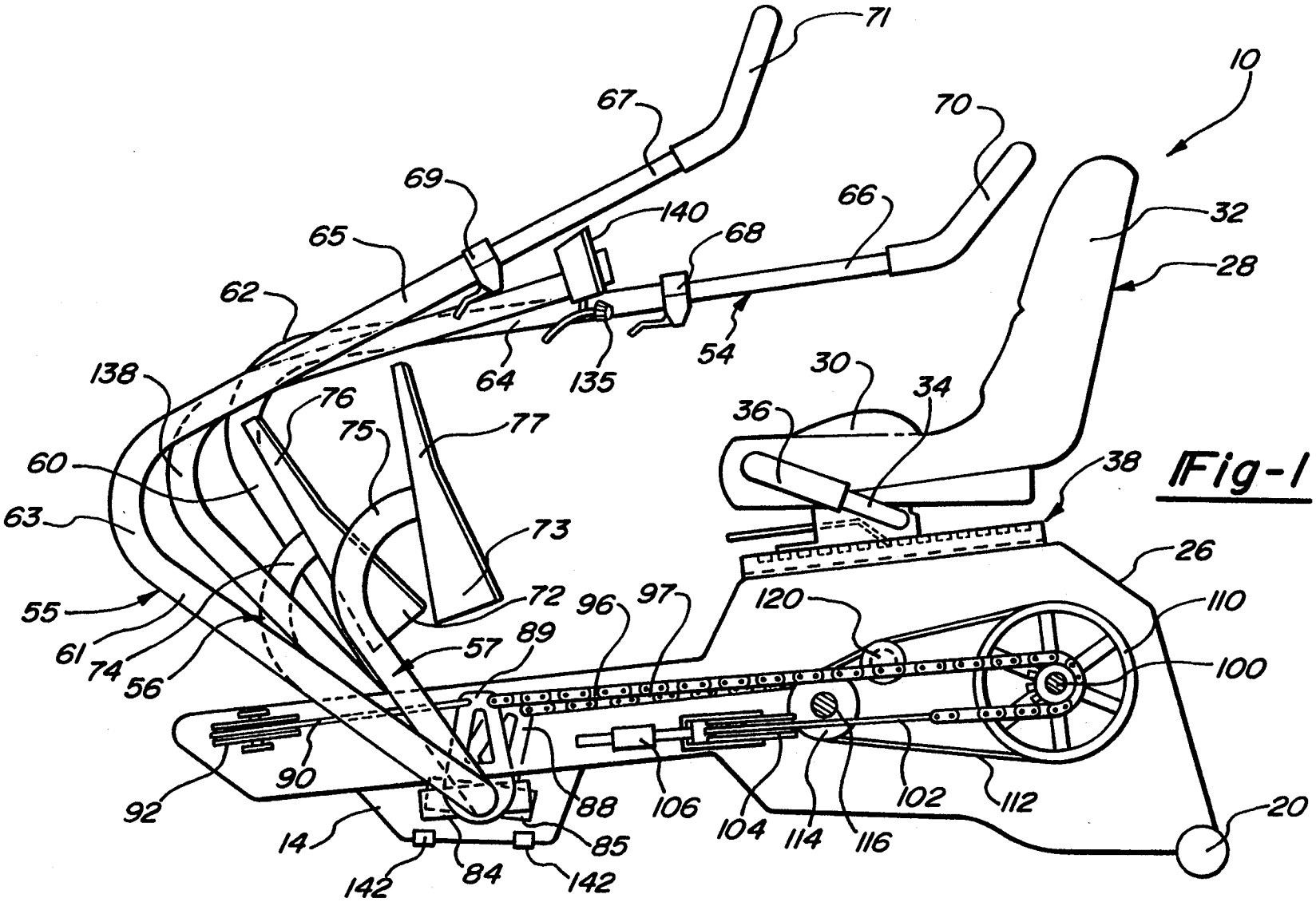
FIG. 1 is a side elevational view with portions broken away of an apparatus embodying the principles of the present invention.

Referring now to the drawing, an apparatus embodying the principles of the present invention is illustrated in FIG. 1 and generally designated at 10. Generally, the apparatus 10 is a physical therapy or exercise device which could be referred to as a total body, recumbent stepping machine.

The apparatus 10 is a total body exerciser since it strengthens or rehabilitates all of the major muscle groups while also providing for effective cardiovascular conditioning. The apparatus is recumbent since the patient or user is generally in a reclined position when it is being used. The apparatus 10 can be referred to as a stepper since it exercises the legs of the user through an oscillating or reciprocating movement of the pedals and through the offering resistance to pushing of the pedals. While pushing resistance exercises the legs and lower body of the user, the exercising of the upper body and arms is through pulling or pushing resistance offered through a pair of handles.

Generally the apparatus or exercise machine 10 of the present invention is comprised of a frame 12 which includes a front support 14 and a rear support 16 which provide the machine 10 with a high degree of stability during use. The frame 12 also includes a central portion 18, extending between the front and rear supports 14 and 16, which generally defines a casing that partially encloses and supports the resistance assembly as further discussed below. Some of the components of the resistance assembly are supported on the central portion 18 of the frame 12 and are enclosed within a housing 26 that prevents their inadvertent contact with the patient or the patient's clothing during use of the machine 10.

Figure 4:
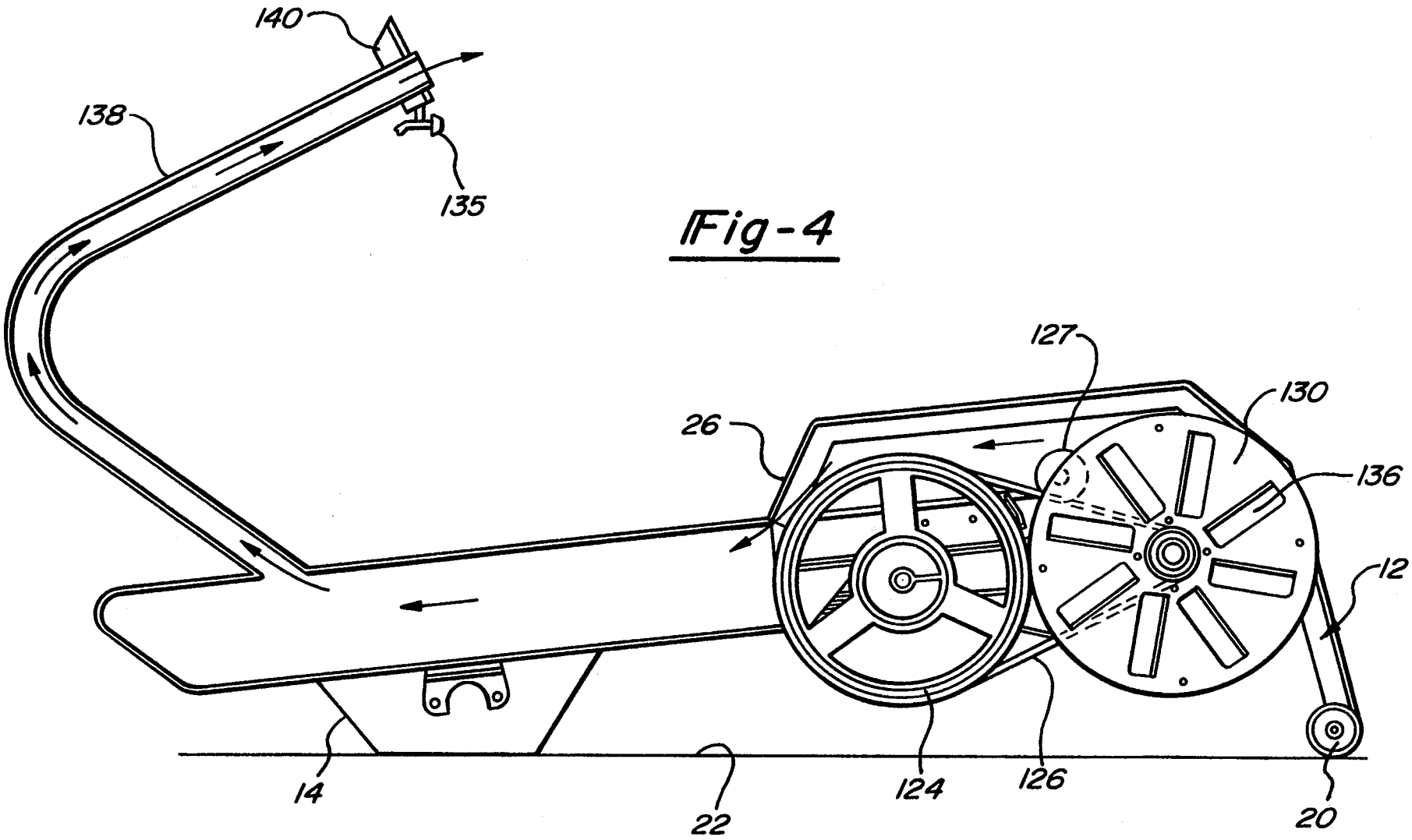
FIG. 4 is a diagrammatic illustration of the present invention showing an air blower feature thereof.
Figure 5:
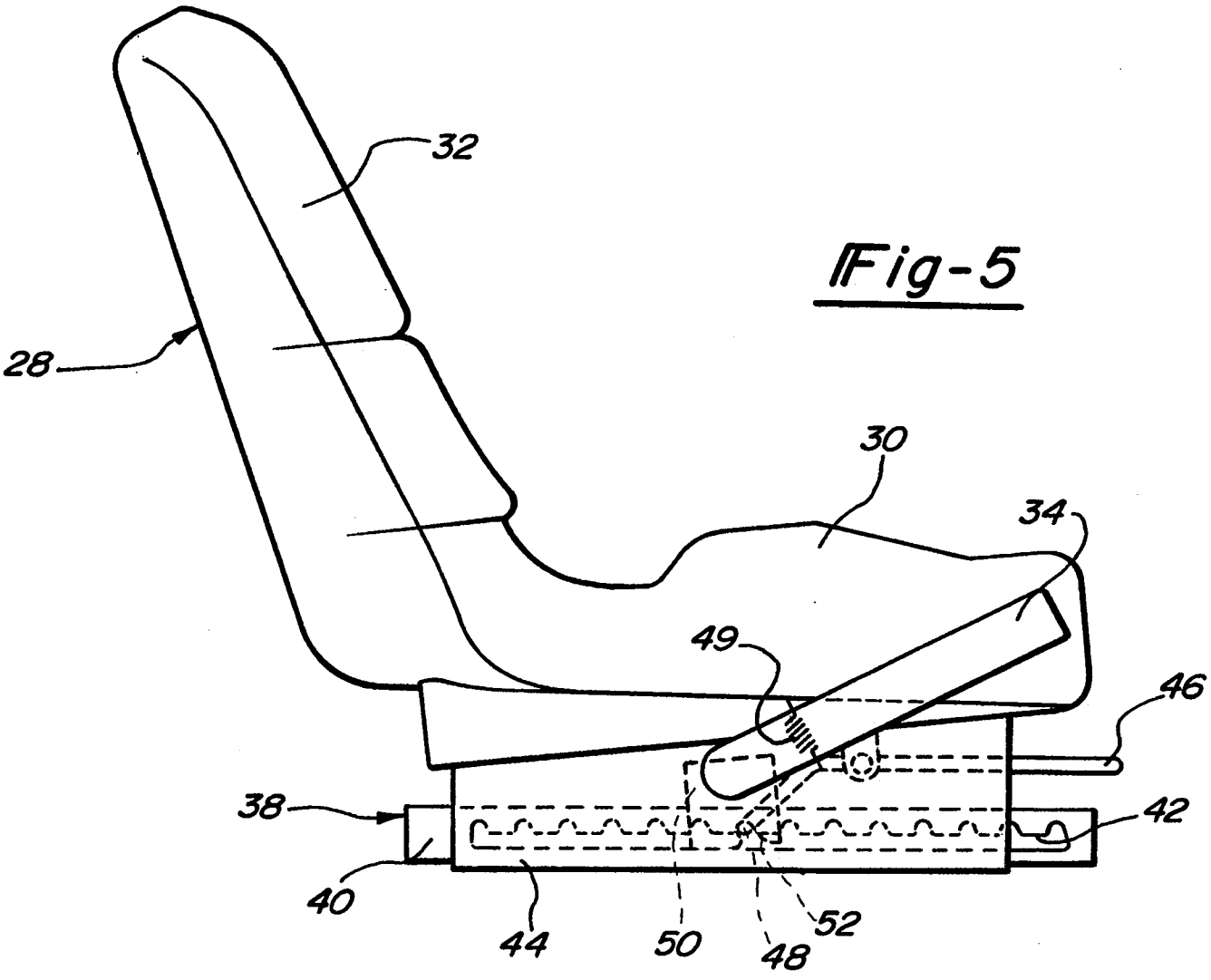
FIG. 5 is a side elevational view of the seat assembly utilized with the present invention.

Preferably, the frame 12 is made from steel in various stock forms such as plate stock, angle stock or tubular stock. As seen in the illustrated embodiment, the tubular rear support 16 defines a T-section with the central portion 18 and the front support 14 which are made of plate stock. The front support 14 is spaced from the rear support 16 generally along a central axis 24 which bisects the rear support 16. Rolling wheels 20 are provided on the ends of the rear support 16 for contact with the floor supporting the exercise machine 10. The floor is generally designated at 22 in FIG. 4.

A seat 28, having a seat cushion 30 and a seat back 32, is adjustably mounted on the frame 12 for varied positioning along the central axis 24. The seat 28 is generally of the full bucket variety and is padded for the comfort of the user. Located toward the rear of the frame 12, the seat 28 is positioned so that the height of the seat cushion 30 approximates the height of a standard chair thereby inherently increasing the user's familiarity with the machine 10. Also, the slope along the top of the housing 26 allows the height of the seat 28 to be lowered as it is adjusted forward for shorter users and raised as it is adjusted rearward for taller users. Laterally outboard of the seat cushion 30 are a pair of stationary grab bars 34 having padded grips 36 on their ends. The grab bars 34 are provided so that the user has an alternate holding position when upper body conditioning is not desired.

As mentioned above, the seat 28 can be adjustably positioned axially along the central axis 24. This is accomplished through an adjustment mechanism 38 of the rack and slider variety. The adjustment mechanism 38 includes a stationary rack 40 having a toothed slot defined along its length. A movable rack 44, secured to the underside of the seat 28, is mounted for sliding movement relative to the stationary rack 40. A lever arm 46 is pivotally mounted to the seat 28 and includes a pin 48 biased by a spring 49 so as to engage the serrated portions of the toothed slot 42. By lifting upwardly on the lever arm 46, the pin 48 is disengaged from a serration in the toothed slot 42 enabling the seat 28 and movable rack 44 to slide along the central axis 24. Once the seat 28 has been moved to the desired position, the lever arm 46 is released and the spring 49 causes the pin 48 to engage another serration of the toothed slot 42. The adjustment mechanism 38 is also provided with a retaining block 50 having a slot 52 defined therein. The block 50 and slot 52 prevent the pin 48 from inadvertently becoming disengaged from a serration of the toothed slot 42. The retaining block 50 is movable with the movable rack 44 and its slot 52 corresponds with the location of the pin 48. While one specific variety of adjustment mechanism 38 has been specifically described in detail, it will be appreciated that numerous other types of adjustment mechanisms could be substituted for the mechanism 38 illustrated and discussed above. Alternate mechanisms are therefore deemed to be within the purview of this invention.

Located forward of the seat 28 are a pair of arm assemblies 54 and 55 and a pair of leg assemblies 56 and 57, all of which are configured to undergo oscillating or reciprocating movement about a common pivot axis 58. The pivot axis 58 extends generally parallel to the rear support 14 and is located so as to generally correspond with the front support 16 at a low height relative to the seat 28 and close to the floor 22.

The arm assemblies 54 and 55 include lower levers 60 and 61 which extend forward and upward from the pivot axis to elbows 62 and 63. Thereafter, the arm assemblies 54 and 55 extend rearward and upward toward the seat 28 along upper extensions 64 and 65. Handles 66 and 67 are slidable received in the upper extensions 64 and 65 and are provided with key-way slots 53 so as to prevent their rotation relative to the upper extensions 64 and 65. The handles 66 and 67 can be adjusted in length and for this reason locking levers 68 and 69 are provided on the upper extensions 64 and 65 to secure them at the desired length. The ends of the handles 66 and 67 are generally bent upward and inward relative to the remainder of the handles 66 and 67 and are provided with padded grips 70 and 71 for the user's comfort.

The leg assemblies 56 and 57 similarly extend forward and upward from the pivot axis 58 along levers 72 and 73. The levers 72 and 73 include elbow portions 74 and 75 at their upper ends which bend back in a direction toward the seat 28 and to which are attached pedals 76 and 77. The pedals are preferably secured to the levers 72 and 73 in a pivotable manner, but could alternatively be rigidly secured thereto. The pedals 76 and 77 are provided with heel cups 78 and 79 at their lower ends so that the foot of a user will not inadvertently slip off of the deck portion of the pedals 76 and 77.

The geometry and orientation of the seat 28, handles 66 and 67, the pedals 76 and 77 and the pivot axis 58 are set relative to one another so that, regardless of the size of the person using the machine 10, once properly adjusted, the resulting movement and form during upper and lower body conditioning is biomechanically correct and efficient. This is particularly important in the physical therapy setting where the proper form can result in quicker and safer recovery and rehabilitation.

Figure 2:
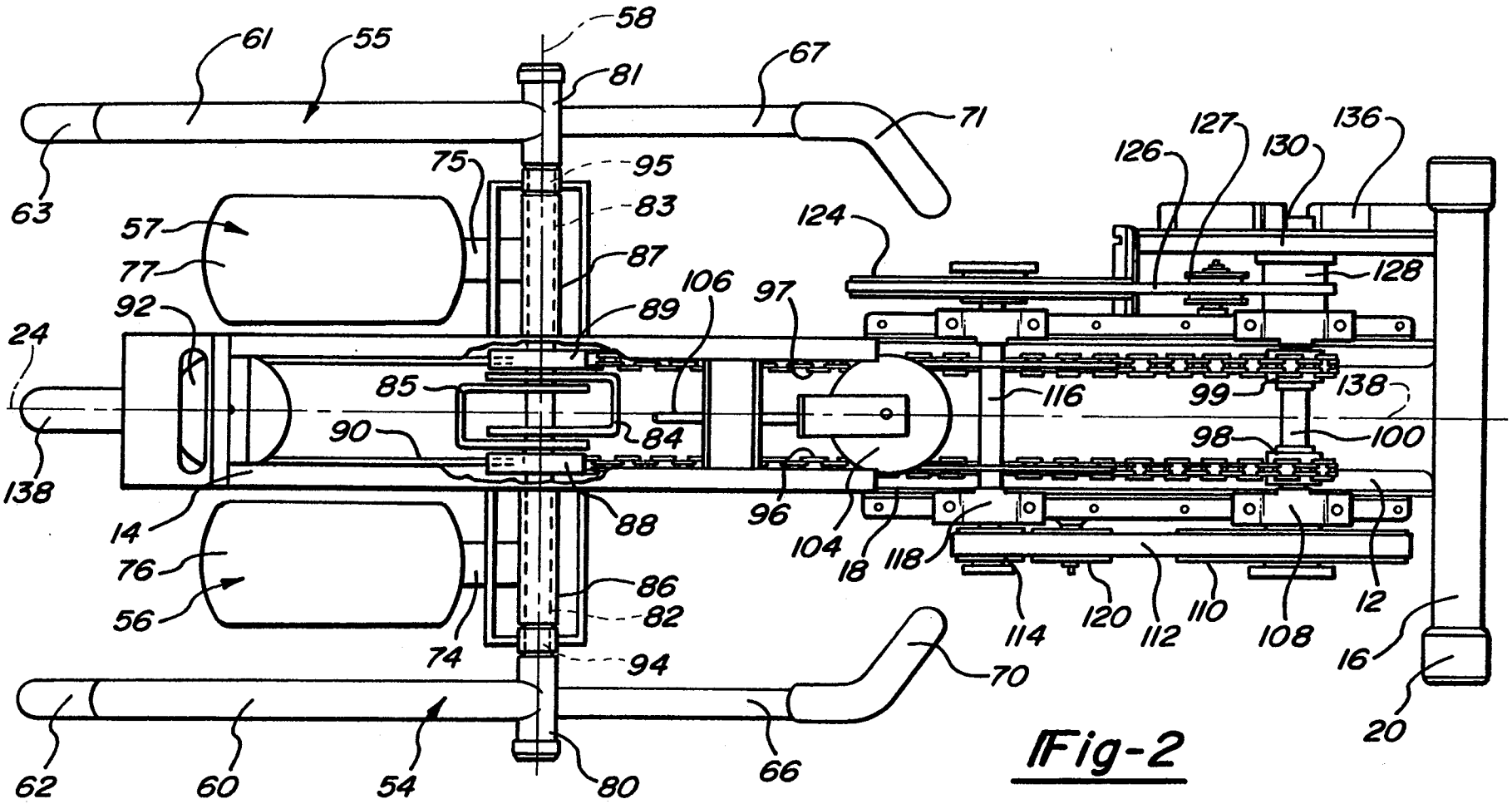
FIG. 2 is a bottom view with portions broken away of the apparatus shown in FIG. 1.

The arm assemblies 54 and 55 are connected to the leg assemblies 56 and 57 for contralateral movement about the pivot axis 58. To accomplish this, a series of coaxial sleeves are assembled along the pivot axis 58. As seen in FIG. 2, the lower levers 60 and 61 of the arm assemblies 54 and 55 terminate in transverse sleeves 80 and 81 which are coaxial with the pivot axis 58. Similarly, the levers 72 and 73 of the leg assemblies terminate in transverse sleeves 86 and 87 coaxial with the pivot axis 58 and inboard of the arm sleeves 80 and 81.

The arm sleeves 80 and 81 each include a reduced diameter shaft 82 and 83 which extends inboard along the pivot axis 58. Bushings 94 and 95 support the shafts 82 and 83 on the front support 14 and the frame 12. Each shaft 82 and 83 is connected by bolts (not shown) to a U-shaped linkage 84 and 85. The U-shaped linkages 84 and 85 are generally oriented in a horizontal plane and are generally offset from one another so that the legs of one U-shape linkage 84 are alongside or overlap those of the other linkage 85. Thus, the open portions of the U-shaped linkages 84 and 85 face toward one another. As seen in FIG. 2, the shaft 82 of the right side arm assembly 54 extends through the outboard leg of the right side U-shaped linkage 85 before terminating in a rigid connection to the leg of left side U-shaped linkage 84. Similarly, the shaft 83 of the left side arm assembly 55 extends through an aperture in the outboard leg of the left side U-shaped linkage 84 before terminating in a rigid mounting to the leg of the right side U-shaped linkage 85.

The pedals 76 and 77 are connected for contralateral movement with the handles 67 and 66. To connect the leg assemblies 56 and 57 with the arm assemblies 54 and 55, the leg levers 72 and 73 terminate in transverse sleeves 86 and 87 that are coaxial with the pivot axis 58. The sleeves 86 and 87 are respectively mounted on the reduced diameter shafts 82 and 83 for relative pivotal movement and are separated from the arm sleeves 80 and 81 by the bushings 94 and 95 mentioned above. The sleeve 86 of the right leg assembly 56 is rigidly secured to the outboard leg of the right side U-shaped linkage 85 which, as discussed above, is coupled to the left arm lever 55. Correspondingly, the sleeve 87 of the left leg assembly 57 is rigidly secured to the outboard leg of the left side U-shaped linkage 84 so that it will rotate with the right arm lever 54. While one specific embodiment is illustrated for contralaterally coordinating the movement of the arm and leg assemblies 54, 55, 56 and 57, it should be understood that additional methods for coordinating this movement could also be readily provided and are deemed to be within the purview of this invention.

The range of pivotal movement which the arm and leg assemblies 54, 55, 56 and 57 may undergo is limited by bumpers 142. The bumpers 142 are positioned in the front support 14 so as to engage the U-shaped linkages 84 and 85 and limit the forward and rearward movement thereby preventing further rotation about the pivoting axis 58. By increasing or decreasing the size or height of the bumpers 142, the actual range of movement of the arm and leg assemblies 54, 55, 56 and 57 can be adjusted. The length and geometry of the arm and leg assemblies 54, 55, 56 and 57 are provided so that the pedals 76 and 77 undergo a range of motion or "step" of approximately eleven (11) inches while the handles 66 and 67 undergo a twenty (20) to twenty-seven (27) inch range of motion, depending on the adjusted length of handles 66 and 67. Because this movement is about the pivoting axis 58, the movement of the pedals 76 and 77 and the handles 66 and 67 is arcuate.

The movement of one set of arm and leg assemblies 54 and 57 is tied to the movement of the other set of arm and leg assemblies 55 and 56 so that movement of one induces a counter movement in the other. In other words, as one set moves forward the other set moves backward. To coordinate this movement, a pair of yokes 88 and 89, provided outboard of the U-shaped linkages 84 and 85, are secured to the U-shaped linkages 84 and 85 by fasteners such as bolts (not shown) so that they move with the linkages 84 and 85. The yokes 88 and 89 are connected together by a front or forward extending cable 90. The cable 90 extends forward from one yoke 88 and is looped around a pulley 92 which returns it for securement to the other yoke 89. The pulley is mounted to the frame 12 so that it will rotate about an axis generally perpendicular to the central axis 24. A cable adjustment mechanism can be provided on the yokes 88 and 89 or on the pulley 92 so that the tension of the cable 90 can be adjusted as needed for proper operation of the machine 10.

To provide resistance to the movement of the arm assemblies 54 and 55 and the leg assemblies 56 and 57, a brake or resistance assembly is coupled to the yokes 88 and 89. While only one embodiment of the resistance assembly is being described in detail, it will become apparent that a number of known resistance assemblies could be readily employed with the present invention. One such resistance assembly would be an eddy current resistance assembly presently used in other exercise machines.

To couple the yokes 88 and 89 to the resistance assembly, a pair of interconnected chains 96 and 97 are used. The chains 96 and 97 extend rearward from the yokes 88 and 89 with each passing over a one-way clutch and sprocket assembly 98 and 99, of a known variety. The clutch and sprocket assemblies 98 and 99 are mounted on a primary drive shaft 100 so that the coordinated arm and leg assemblies will alternately drive the drive shaft 100 for rotation in one direction. After being looped around the one-way clutch and sprockets assemblies 98 and 99, the chains 96 and 97 extend forward and terminate in a cable 102 commonly extending between the two. The common cable 102 is looped around a pulley 104 that is adjustably secured by a bolt 104 to the frame 12. In this manner, the contralateral movement of the coordinated pairs of arm and leg assemblies 54, 56 and 55, 57 are synchronized so that resistance is constantly being applied.

Figure 3:
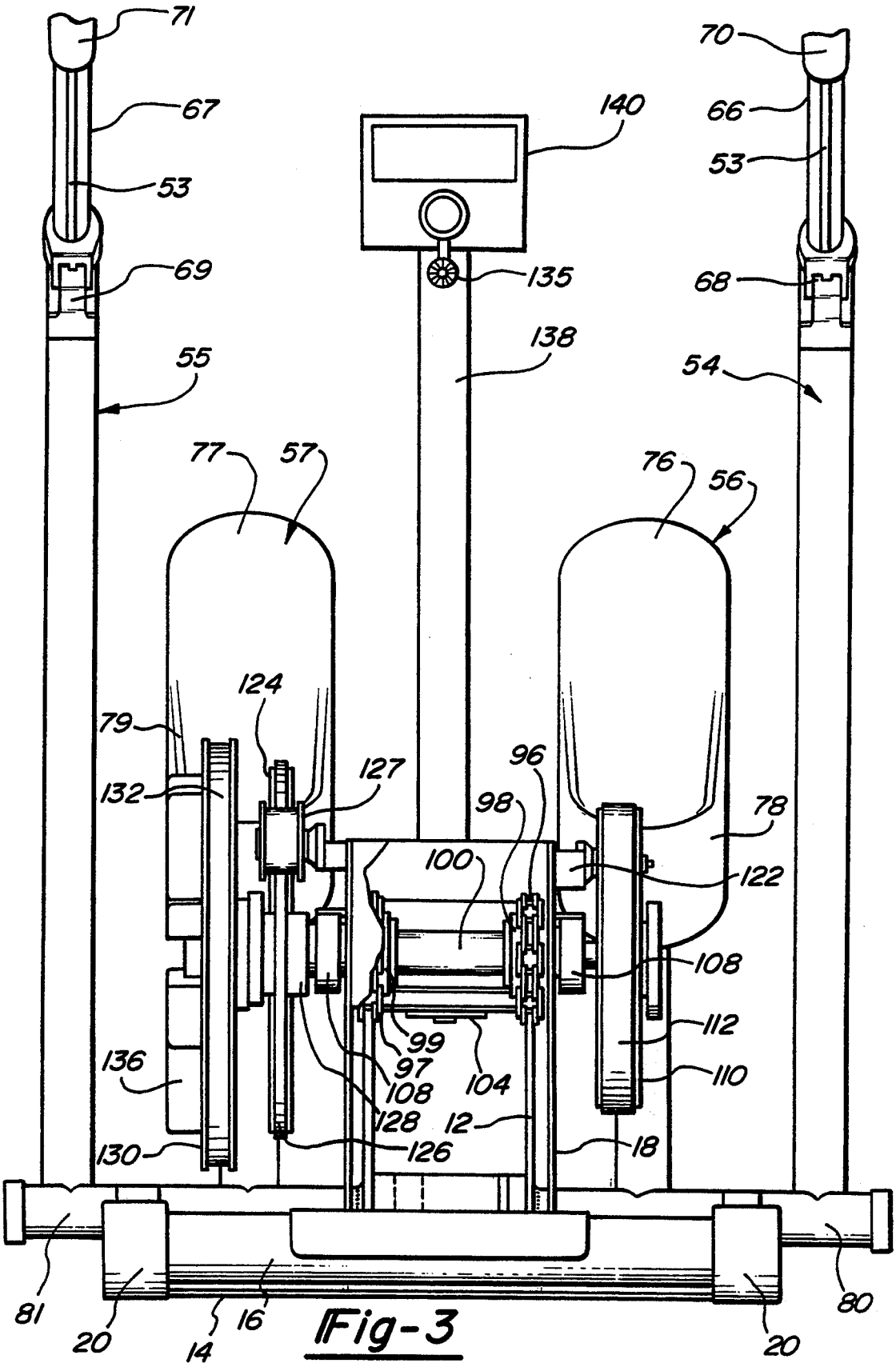
FIG. 3 is a rear view of the apparatus seen in FIG. 1 having portions removed therefrom for clarity.

The drive shaft 100 is journaled in bearings 108 supported by the frame 12. Outboard of the right bearing 108, as seen in FIGS. 2 and 3, a pulley 110 is mounted for rotation with the drive shaft 100. The pulley 110 is connected by a belt 112, which may be toothed, to a smaller diameter pulley 114 so as to increase the rate of rotation of a secondary drive shaft 116 journaled within bearings 118 supported by the frame 12. To ensure proper tension on the belt 112, a tension pulley 120, including an eccentric mounting 112 for adjustment, is provided to engage the belt 112.

The other end of the secondary shaft 116, opposite of the pulley 114, has an increased diameter pulley 124 mounted thereon and which is coupled by a V-belt 126 to a reduced diameter pulley 128, also supported by the frame 12 for rotation. As with the toothed belt 112, tension of the V-belt 126 is adjustable through a tension pulley 127.

A flywheel 130, having an increased diameter, is mounted to rotate with the reduced diameter pulley 128. A friction belt 132 is positioned so as to extend around and be retained on the perimeter of the flywheel 130. Preferably, the belt 132 is mounted so that it will not rotate with the flywheel 130. Suitable materials for the friction belt 132 include felt, nylon and other materials which will not readily wear as a result of frictional contact with the perimeter of the flywheel 130. The braking force or tension exhibited by the friction belt 132 on the flywheel 130 can be adjusted by a tension adjustment mechanism as generally designated at 134. This tension adjusting mechanism 134 can be one of the well known varieties and may include a bolt movably engaged with the frame 12 and secured through a spring connection to the friction belt 132. A cable is used to connect the tension adjustment mechanism 134 to a tension control knob 135 which allows the user to adjust the tension of the belt 132.

By providing the resistance assembly with a rotational increase from the primary drive shaft 100 to the flywheel 130, a substantial apparent inertia will be realized by the patient which can be adjusted through the tension adjustment mechanism 134.

As seen in FIG. 1, the machine 10 of the present invention is provided so that it has an open area immediately forward of the seat 28 and rearward of the arm and leg assemblies 54, 55, 56 and 57. Also, that portion of the frame 12 which extends across this open area is provided with a low height or profile, approximately $8\frac{1}{2}$–$9\frac{1}{2}$ inches. The combination of the open area and the low profile give the present invention a step-through design not previously seen in exercise or physical therapy machines. The step-through design increases the ease of ingress and egress for the user and in particular for the low mobility patient. Ingress and egress are further enhanced by the single pivot axis 58 and the forwardly bowed shape of the arm and leg assemblies 54, 55, 56 and 57 which cooperate to open up the step-through area. It will also be noticed that, regardless of the relative position of the arm and leg assemblies 54, 55, 56 and 57, the user is always capable of laterally stepping out of the pedals 76 and 77 without interference from the lower levers 60 and 61 of the arm assemblies 56 and 57.

To increase the comfort and convenience of the user, the machine 10 of the present invention includes a blower assembly which is operated off of the rotation of the flywheel 130. As diagrammatically illustrated in FIG. 4, fan blades 136 are provided on the flywheel 130 so that air is blown through a duct (not shown) in the housing 26, as indicated by the arrows, during rotation of the flywheel 130. At the forward end of the housing 26, an air tube 138, having the same general shape as the arm assemblies 54 and 55, extends upwardly and bends back to generally direct the air toward the user. The air tube 138 can be provided with an adjustable vent louver to more precisely direct the air flow.

The machine 10 of the present invention is also provided with an onboard control system, generally designated at 140, which includes a display panel. The control system 140 can be programmed so that it will provide information to the user or to the physical therapist with respect to work output, calories consumed, rpm level, pace information, workout duration, etc. As such, the control system is connected so as to monitor the resistance provided by the friction belt 132, the rpm of the flywheel 130 as well as the steps from the handles 66 and 67 and pedals 76 and 77. The control system can be powered by batteries or directly off of the resistance assembly or flywheel.

Additional benefits and advantages of the present invention will become apparent to those skilled in the art to which this invention relates from the subsequent description of the preferred embodiments and the appended claims taken in conjunction drawings.

We claim:

1. A recumbent apparatus for exercise and physical therapy providing a lower body workout, an upper body workout and cardiovascular conditioning, said apparatus comprising:

a frame having a forward end and a rearward end, said frame generally defining a longitudinal axis extending between said forward and rearward ends;

a seat supported by said frame and positioned generally toward said rearward end, said seat including a seat cushion and a seat back;

a left leg assembly and a right leg assembly, said leg assemblies supported by said frame for pivoting movement about a pivot axis transverse to said longitudinal axis, said leg assemblies positioned generally toward said forward end and each including an upwardly extending leg lever terminating in a pedal;

a left arm assembly and a right arm assembly, said arm assemblies supported by said frame for pivoting movement also about said pivot axis, said arm assemblies positioned generally toward said forward end and each including an upwardly extending arm lever terminating in a handle;

said left leg assembly being connected to said right arm assembly enabling movement therewith and defining a first connected assembly, said right leg assembly being connected to said left arm assembly enabling movement therewith and defining a second connected assembly, said first connected assembly coupled to said second connected assembly such that forward movement in one of said connected assemblies induces rearward movement in the other of said connected assemblies thereby enabling contralateral movement of said arm and leg assemblies;

resistance means coupled to said arm and leg assemblies for providing resistance to movement of said arm and leg assemblies about said pivoting axis; and an open area being defined above said frame and between said seat and said arm and leg assemblies, said open area providing step-through access to said seat regardless of relative arm and leg assembly positions.

2. An apparatus as set forth in claim 1 wherein said seat is reclined.

3. An apparatus as set forth in claim 1 wherein said seat cushion is positioned at a standard seat height.

4. An apparatus as set forth in claim 1 wherein arm levers extend upward and forward from said pivot axis before terminating in said handles.

5. An apparatus as set forth in claim 1 wherein said arm levers extend upward and forward from said pivot axis and then extend rearward generally toward said seat before terminating in said handles.

6. An apparatus as set forth in claim 1 wherein said handles are adjustable with respect to their positioning relative to said seat and said arm levers.

7. An apparatus as set forth in claim 1 wherein said leg levers extend upward and forward from said pivot axis before terminating in said pedals.

8. An apparatus as set forth in claim 1 wherein said leg levers extend upward and forward from said pivot axis and then extend rearward generally toward said seat before terminating in said pedals.

9. An apparatus as set forth in claim 1 wherein said seat is longitudinally adjustable in position relative to said pedals.

10. An apparatus as set forth in claim 1 wherein said frame is less than half the height of said seat in said open area.

11. An apparatus as set forth in claim 1 wherein said pedals, said seat and said handles are oriented relative to one another such that during use proper form of a user is provided regardless of the size of the user.

12. An apparatus as set forth in claim 1 further comprising blower means for forcibly blowing air toward said seat.

13. An apparatus as set forth in claim 12 wherein said blower means is coupled to said resistance means, said blower means being operated by movement of said arm and leg assemblies.

14. An apparatus as set forth in claim 12 wherein said blower means includes a blower tube at said forward end, said blower tube extending upward and forward from said frame and then extending rearward generally toward said seat.

15. An apparatus as set forth in claim 1 wherein said leg assemblies are located inboard of said arm assemblies.

16. An apparatus as set forth in claim 15 wherein said pedals have unobstructed lateral access thereto regardless of said arm assembly positioning.

17. An apparatus as set forth in claim 15 wherein said pedals are positioned on said leg levers such that said pedals are always located rearward of adjacent portions of said arm levers.

18. An apparatus as set forth in claim 1 wherein said frame has a height in said open area within the range of 6–12 inches.

19. An apparatus as set forth in claim 1 wherein said frame has a height in said open area within the range of $8\frac{1}{2}$–$9\frac{1}{2}$ inches.

* * * * *